United States Patent [19]

Anson

[11] 4,312,301

[45] Jan. 26, 1982

[54] CONTROLLING STEAM TEMPERATURE TO TURBINES

[75] Inventor: Donald Anson, Worthington, Ohio

[73] Assignee: Battelle Development Corporation, Columbus, Ohio

[21] Appl. No.: 113,246

[22] Filed: Jan. 18, 1980

[51] Int. Cl.[3] ..... F22B 1/02

[52] U.S. Cl. ..... 122/4 D; 110/263; 110/347

[58] Field of Search ..... 122/4 D; 110/245, 263, 110/342, 347; 431/7; 432/170, 58; 34/57

[56] References Cited

U.S. PATENT DOCUMENTS

| | | | |
|---|---|---|---|
| 3,884,193 | 5/1975 | Bryers | 122/4 D |
| 4,084,545 | 4/1978 | Hack et al. | 110/342 X |
| 4,085,593 | 4/1978 | Larsen | 122/4 D X |
| 4,111,158 | 9/1978 | Reh et al. | 122/4 D |

OTHER PUBLICATIONS

Reh, *Fluid Bed Combustion in Processing Environmental Protection and Energy Supply,* American Flame Research Comm., Apr. 1979.

*Primary Examiner*—Edward G. Favors
*Attorney, Agent, or Firm*—Barry S. Bissell

[57] ABSTRACT

An entrained bed combustor may provide constant temperature, superheated steam to a power generating steam turbine independent of the load on the turbine. In a conventional utility boiler heat is transferred in series to the steam generator, superheater and reheater. With the present invention these components may be run in parallel with heat transfer from the entrained bed particles enabling faster start-up and a turn-down capability without a reduction in the superheated steam temperature.

15 Claims, 6 Drawing Figures

CONTROLLING STEAM TEMPERATURE TO TURBINES

BACKGROUND OF THE INVENTION

A problem which is of considerable concern to electric utilities is posed by cyclic loading of large steam power plants. Steam turbines in the 200 MW class and larger, typically with steam conditions of 1000° F. and 2400 psi or above, have strict restraints on the rate at which steam temperatures can be varied. Whenever a steam temperature change is imposed, the large mass of metal in the turbine casing and rotor take time to reach a new equilibrium. In the transient condition, thermal stresses are induced that are capable of causing permanent damage. The conventional gas, oil or coal-fired boiler, and particularly the pulverized coal-fired boiler, provides a constant steam temperature over a very limited load range, typically above about two thirds of its rated capacity.

During low load running or start up, steam temperatures may be more than 300° F. below the design level, necessitating extended periods for cooling the turbine before shut down or load reduction, and for reheating the turbine before reloading. This is costly in terms of reduced efficiency, steam dumping and possible thermal cycling damage.

The present invention provides a novel approach to the design of a steam boiler in which the final steam temperature may be matched to the turbine over the whole load range, including hot and warm starts.

SUMMARY OF THE INVENTION

It is an object of the invention to provide a method of providing superheated steam at constant or controlled temperature independent of steam flow rate.

It is also an object to provide such superheated steam to a steam turbine operating with variable load.

It is further an object of the invention to provide a method of controlling the relative amount of heat provided for steam generation, steam superheating and steam reheating in a steam supply system.

It is also an object to provide reheated steam at constant or controlled temperature as required by a steam turbine with single or multiple reheat stages operating with variable load and during start-up and shut-down operations.

It is finally an object to provide a steam generator and a method of operating said generator for providing controlled temperature superheated steam independent of steam volume requirements and for providing more efficient start-up of steam turbines after low-load or shut-down periods.

In accordance with the objectives, the invention is a method of operating a combustor and controlling the relative amount of heat provided from the combustor to a steam generator, steam superheater and steam reheater such that the superheated steam temperature can be controlled to a desired level independent of the steam flow rate. The method comprises generating heat from the combustion of fuel in an entrained bed combustor of the type having a relatively fine particle fraction entrained in a fluidizing gas, transferring the heat of combustion to the fine entrained bed particles, providing independent flow paths for the fine particles through the steam generator, steam superheater and steam reheater such that they function as parallel components, and directing preselected quantities of the fine particles through the independent flow paths such that heat is supplied to the generator, superheater and reheater from the fine particles in the desired relative amounts. The actual heat delivered to each component is controlled by adjusting the total amount of heat generated in the combustor and transferred to the fine particles and by the quantity of fine particles directed through each component heat exchanger.

The inventive method preferably comprises recycling the fine entrained bed particles in the desired proportion through the heat exchange components and back into the combustor to be reheated and recirculated.

The method preferably further comprises the use of a combustor of the multisolid fluidized bed type having, in addition to the entrained bed particles, a dense fluidized bed of relatively coarse particles which remains stable in the combustor and into which a portion of the recirculating entrained bed particles are recycled.

In some cases a preselected portion of the fine entrained bed particles may bypass all of the heat exchange components. In other cases preselected portions may be recycled through two or all three of the components, for example, through both the steam generator and the superheater, while a second preselected portion is recycled only through one of the components, for example, the superheater. The parallel controlled flow paths through the heat exchange components is the feature of the present invention which allows the operator to match the steam requirements in terms of volume and temperature (also pressure) of the intended use. The present invention is particularly adapted to use in steam turbines for power generation.

Gases from the combustor are separated from the fine entrained particles prior to the latters entry into the heat exchange components. These gases may therefore be conventionally used in an economizer or other convective heat transfer devices of the system.

DETAILED DESCRIPTION OF THE INVENTION

Figure 1:
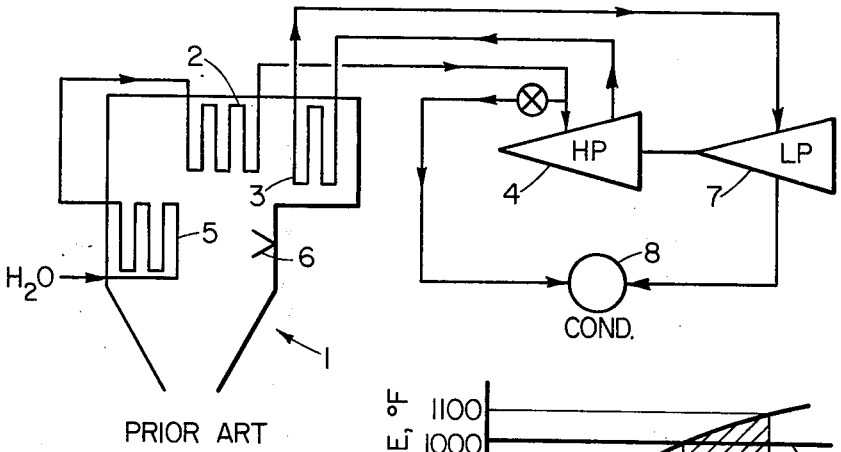
PRIOR ART FIG. 1
FIG. 1 is a schematic diagram of a prior art, conventional steam generator used in the electric power industry.

In steam power plants, water tube boilers are used to supply superheated steam to turbines which in turn run the power generators. As shown schematically in FIG. 1, water is passed through heat exchange tubing 5 forming the internal walls of the boiler 1 and is vaporized by the heat from the boiler burners 6. Radiant heating from the proximate flame is the primary mechanism of heat transfer.

In the conventional boiler the steam generated in the lower portion is passed through tubing into the superheater structure 2 generally above the steam generation area and the burners. The superheater 2 is an extensive serpentine heat exchanger which is heated primarily by convection from the hot gases generated by combustion in the boiler. The purpose of the superheater is of course to bring the temperature of the steam up to the level demanded by the turbine. Water is typically injected into the superheater at controlled rates to ensure that the steam temperature does not exceed the safe upper limit dictated by material properties. A reheater 3, which is a tubular heat exchanger located near the superheater, has a similar purpose in reheating steam exhausted from the high pressure turbine 4 before the steam is further expanded in the low pressure turbine 7. Exhausted steam from the low pressure turbine is sent to the condenser 8 for recycle.

Whenever the turbine is running at its rated load, the above apparatus is capable of providing adequate steam at closely controlled conditions, typically on the order of 1000° F. and 2400 psi. In fact, the above apparatus is conveniently used when the turbine is loaded above about 70% of its rated capacity.

Figure 3:
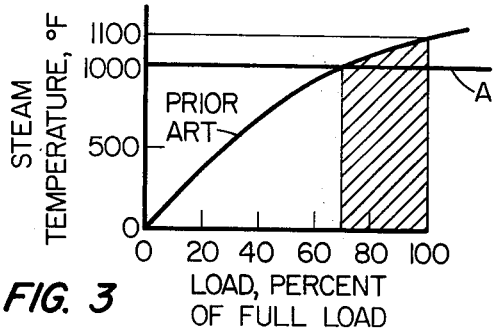
FIG. 3 is a graph comparing the effect of the load factor on the steam temperature for the prior art generator and the present invention.

However, under lower loading or when the turbine is fully shut down either intermittently or periodically, for example overnight or on weekends, the above described boiler experiences some problems due to its construction. Specifically, the steam generator, the superheater and the reheater (which collectively will be referred to herein as heat exchange components) of the conventional boiler are in a series relationship to the transfer of heat from the flame and the hot gases. This arrangement is capable of providing constant temperature steam to the turbine over a relatively narrow load range. Looking at FIG. 3 it is seen that the steam temperature provided by the prior art apparatus is directly affected by the rate of firing of the boiler to match the turbine load. This may be explained by considering the mechanism of heat transfer in the steam generator and superheater. In a low load condition, the steam requirements are reduced and the firing rate of the boiler is reduced accordingly. The available heat is thereby reduced proportionally but the flame temperature is reduced only slightly. This means that the heat transferred by radiant heating to the water-wall steam generator is not reduced in proportion to the firing rate and that the relative amount of heat remaining to heat the superheater by convection is significantly reduced leading to a reduction in the superheated steam temperature. The result on the steam temperature caused by a firing rate reduction over a load cycle can be seen in FIG. 3. To reduce steam temperature excursions the boiler is usually designed to generate steam at the desired conditions at about 70% of rated capacity and the tendency for steam temperature to rise at higher loads is countered by injecting water into the superheater. This practice is commonly referred to as desuperheating. In FIG. 3, for example, the boiler may be designed to superheat the steam to 1000° F. at 70% load, which would result in a steam temperature at full load of 1100° F. unless desuperheat control were used to lower the temperature. Therefore, at about 70% load and higher, this design would produce steam temperatures of the desired 1000° F. but, unfortunately, at less than about 70% the steam temperature would be below 1000° F.

When temperature of the steam decreases significantly below the design level during such low loading, long times are required to reduce the temperature of the turbine and to then raise the temperature upon reloading. This is necessitated by the large inertia of the turbine rotor and casing and the need to avoid thermal stress therein. Control of steam temperatures during major load changes in the conventional boiler is exacerbated by the need of operating at a firing rate which does not match the steam demand in order to allow for the thermal inertia of the boiler. During shut-down the boiler would have to be fired at a rate exceeding the steam demand to ensure that steam temperature is maintained. Surplus steam must be dumped. During start-up periods, the boiler would again have to be overfired both to achieve steam temperature and to build pressure. These temperature changes, reduced efficiency, steam dumping and possible thermal cycling damage are costly in terms of energy waste and expense.

The present invention seeks to avoid the problems caused by the design of the conventional boiler with its series arrangement of heat exchange components. The present invention utilizes an entrained bed combustor with external heat exchange components which are arranged in parallel relationship. An entrained bed combustor is a "fluidized" bed in which relatively fine particles are entrained in the fluidizing gas, fuel is burned in a lower region thereof, and heat from the combustion of the fuel is transferred to the entrained particles passing through the combustion region. In the invention, the entrained fine particles are transported out of the combustor by the fluidizing gas and are captured in a cyclone to be thereafter directed in preselected quantities to the heat exchange components. The separated gases are used in convective heat transfer sections such as in an economizer. Preferably, the fine particles are recycled through the heat exchange components in the desired relative amounts and back into the combustor to be reheated and recirculated.

The entrained bed combustor is preferably a multisolid fluidized bed apparatus which is designed to practice the method disclosed in U.S. Pat. No. 4,084,545, which is hereby incorporated herein by reference. Information useful in using the multisolid fluidized bed in the present invention is contained therein and will not be repeated in excessive detail here. In summary, however, the operation of a multisolid fluidized bed comprises forming the entrained bed in a first space region containing the relatively fine solid bed particle component, forming in a more limited space region within the first region a dense fluidized bed containing a relatively larger solid bed particle component essentially comprising a material having long-term physical and chemical stability in the fluidized bed system so as to be substantially non-agglomerating and not subject to substantial attrition therein, providing a recirculation path such as through a cyclone separator and particle reservoir for the fine particle component from the first space region through the dense fluidized bed in the more limited space region, and operating the fluidized bed system at a velocity such that the larger component particles are effectively retained in the dense fluidized bed in the more limited space region, whereas the fine component particles recirculate and interpenetrate therethrough, commingling with the larger component particles. Used as a combustor, fuel such as particulate coal or oil is introduced at the bottom of the dense bed or lump coal is introduced into or above the dense bed and a sorbent material such as limestone may be added above or below the dense bed to capture $SO_2$.

In the above mentioned patent it is disclosed that heat is recovered from combustion of fuel by the placement of heat exchange tubing above the dense bed or externally of the combustor. The present invention utilizes the latter embodiment to provide for control of the relative heat transfer to the steam generator, steam superheater and steam reheater.

Figure 2:
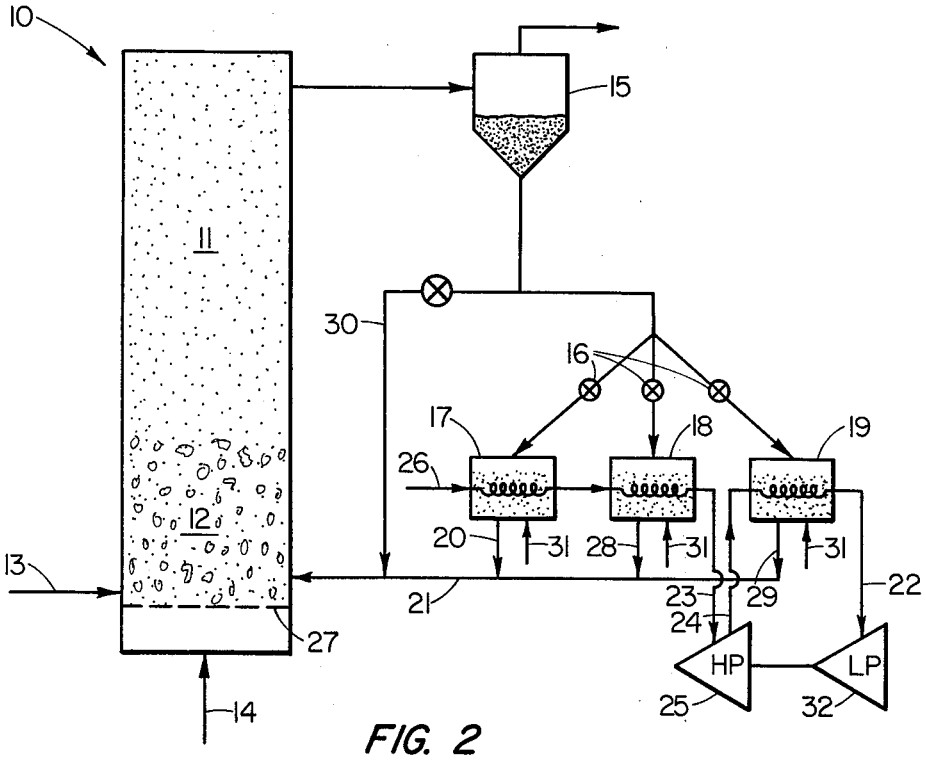
FIG. 2 is a schematic diagram of the present inventive steam generation system used in practising the novel method.

The preferred use of the multisolid fluidized bed is best understood by looking at FIG. 2 which is a schematic drawing of the system employed in practising the invention. Operation of the entrained bed combustor in a single particle mode is similar excepting the contribution of the dense fluidized bed. The combustor 10 is a multisolid fluidized bed such as described in the above mentioned U.S. Pat. No. 4,084,545. A relatively large particle component is fluidized in a dense bed 12 by a fluidizing gas 14 through distributor plate 27. The dense bed region is contained within the larger entrained bed 11 in which relatively fine particles are temporarily retained. The fine particles are entrained in the fluidizing gas 14 and are eventually removed out the top of the combustor and captured in cyclone 15. The fine particles are then recycled back to the dense bed of the combustor through the steam generator 17, steam superheater 18, steam reheater 19 or bypass line 30 via recycle leg 21.

The operation of the novel method may be described as follows. Particulate coal, oil or other fuel is injected into the combustor at 13 and is substantially burned in the combustor dense bed 12. Heat of combustion is transferred to the large particles of the dense bed and the fine entrained bed particles which recirculate through the dense bed and which are retained in the dense bed for a time sufficient to transfer heat by the mixing with the larger particles of the dense bed. After their residence time, the hot entrained fine particles are blown out of the combustor and are captured by the cyclone 15. The hot fine particles are then metered in preselected quantities through the heat exchange components 17, 18 and 19 by valves 16 or other means for controlling volume flow. Water enters the steam generator 17 through line 26 and passes through the heat exchange coils therein in contact with the hot fine entrained particles which pass through the steam generator and exit through line 20 to recycle leg 21. The hot fine particles of course give up heat to the water through the heat exchange tubing and convert it to steam. Heat transfer from the fine particles is enhanced and controlled by fluidizing the hot particles in contact with the heat exchange tubing by controlled injection of fluidizing gas entering at 31.

The steam from the steam generator 17 then passes to the superheater where its temperature and pressure are raised and then proceeds through line 23 to the high pressure steam turbine 25. Heat for superheating again comes from the hot entrained particles which are passed through the superheater 18 in contact with the heat exchange tubing and out through line 28 to recycle leg 21.

Exhausted steam from the high pressure turbine 25 may also be reheated in the same manner if returned through line 22 to the reheater 19. Hot entrained particles are metered through the reheater at a preselected rate and the particles give up heat to the steam before the particles exit through line 29 to recycle leg 21 and the reheated steam passes back to the low pressure steam turbine 32 via line 24 where it is further expanded. A bypass line 30 may also be used to recycle fine particles without passing through any of the heat exchange components.

It may be seen that by controlling the quantity of hot fine particles which pass into each of the steam generator 17, superheater 18 and reheater 19 through valves 16, the amount of heat which is thereby made available in those heat exchange components is also controlled. The heat exchange components are in parallel contrary to the conventional boiler design described above. In this situation the rate of firing and the steam flow may be reduced but the temperature of the superheated steam may be held constant (or at any desired level) by controlling the relative quantities of fine particles recycled through the steam generator and the superheater. Using this novel method of heat allocation, such control of the temperature can be easily obtained using heat transfer practices which are well within the state of the art.

Figure 4A:
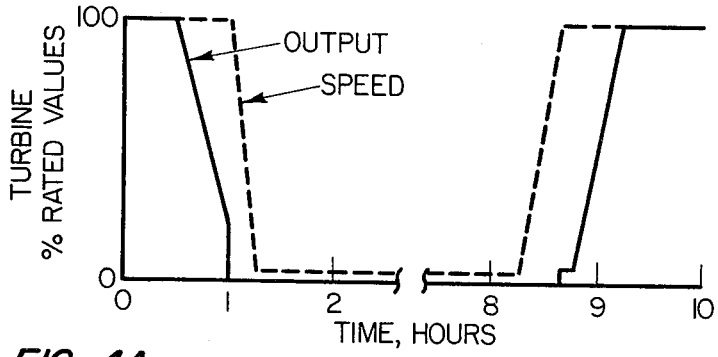
FIGS. 4A, 4B, and 4C are a series of graphs showing the conditions present in an idealized shut down and start up which may be closely followed according to the invention.
Figure 4B:
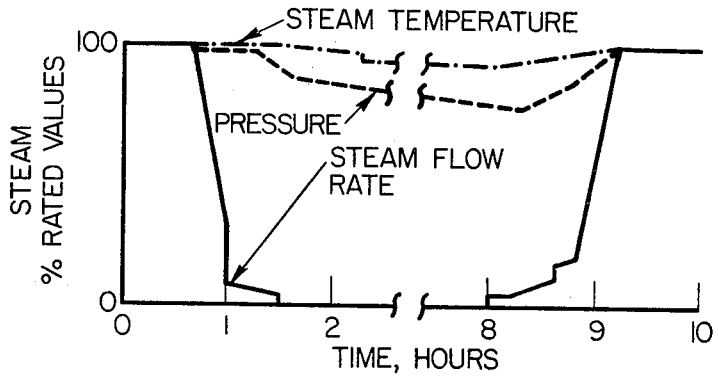

Referring to FIG. 4 the advantage of the above described invention can be seen using a hypothetical, but not uncommon, load cycle in which it is desired to reduce turbine output, shut-down for a period of 8 hours and then restart and fully load the turbine. Specifically, in FIG. 4A, before the unit is tripped, turbine output (KW) is reduced to 20 percent of the nominal power, for example, then disconnected from the load and allowed to run down to turning gear speed (about 6 rpm). To achieve these changes, (see FIG. 4B), steam pressure in the boiler is preferably maintained at nominal value while the steam flow rate is reduced to about 20 percent of nominal by the turbine control valves. When the unit is tripped steam flow stops, apart from any small amount of flow that may be permitted to cool the L.P. turbine. The boiler stop valve is closed when the turbine has run down. Steam temperature, however, is desirably kept at the nominal value throughout, so that the turbine comes off load hot which avoids slow cooling and possible thermal cycling damage.

On restart, a small steam flow is initiated to clear drains, etc., and the boiler pressure is restored since some pressure will have been lost during shutdown. With the steam temperature close to the design value and matched to the turbine temperature, the turbine is then rolled off the turning gear, run up to speed and synchronized. A small load is applied to stabilize the unit. Once stable operation is established, the unit is fully loaded by raising steam flow rate at constant temperature or at a temperature dictated by turbine conditions.

Figure 4C:
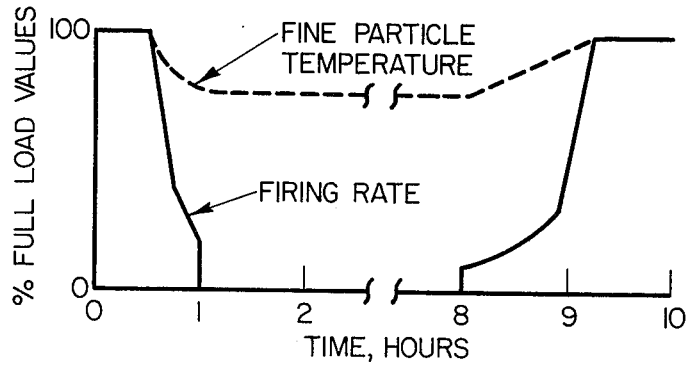

As earlier described, this ideal operating situation can be achieved on a conventional water tube boiler unit only by firing the boiler at a rate which does not match the power demand, to the detriment of the boiler. On the contrary, the present novel method using the multisolid fluidized bed allows the required steam conditions and load to be met independently by manipulating the hot fine particle circulation rate and the firing rate. As represented in FIG. 4C, during the shut-down period the firing rate falls faster than the load to allow the heat transfer (fine entrained particle) bed temperature to fall, so that heat transfer to the steam is reduced in line with the temperature requirement. The balance between the rate of steam generation and the steam temperature is maintained by careful selection of the relative flow of the fine particles in the steam generator, superheater and reheater. To maintain constant temperature at low steam flow rate, the firing rate has only to make up the difference between total heat demand and that supplied by the fine particles on cooling.

During shut down the whole steam circuit remains at a virtually steady temperature which is within the safe operating range for the apparatus. On restart, the firing rate is increased to raise steam pressure, supplying heat for superheat only when required, by diverting hot fine particles to the appropriate heat exchange components. At this stage, firing rate temporarily exceeds the heat demand from the turbine, the excess heat going to heat the fine particle inventory. As soon as the fine particle inventory is heated to the steady state level, the firing rate can be matched to the boiler output.

Comparing the prior art boiler to the present invention it is seen that the present invention allows independent control over the relative amounts of heat supplied to the steam generator and the superheater. This enables the control of steam temperature output independent of steam flow rate. FIG. 3 depicts the marked difference in the ability to maintain temperature at low loads. Curve A represents the output of the present method in contrast to the curve for the prior art boiler. In the present method design steam temperature can be maintained at a constant level for any load.

Moreover, the present method allows much quicker start-ups over the prior boiler since the firing rate may be increased quickly without risk of overheating the superheater or reheater. The heat is then applied selectively to the heat exchange components or the fine particles may bypass the heat exchange components and be recycled directly back to the combustor to raise the temperature of the fine particle inventory. In the prior art boiler where the heat of combustion is applied directly to the steam generation tubing and the superheater tubing, the firing rate must be slowly increased upon start-up until steam is produced and passed through the superheater and reheater. Until then, the tubing can be thermally damaged by high gas temperatures. Additionally, since the turbine is at a much lower temperature under the prior methods during shut-down, the rate of steam temperature increase or restart must be moderated to avoid thermal stresses in the turbine. Thus, a fine balance must initially be maintained in start-up to avoid damage to the superheater, reheater and turbine. Frequently, oil or gas fuel is used during this start-up period in order to maintain adequate control over the heat produced. The present inventive method avoids this and may therefore use only coal on restart.

I claim:

1. A method for generating steam in a steam generator and superheating the steam in a superheater to a desired temperature independent of steam flow rate comprising (A) generating heat from the combustion of fuel in an entrained bed combustor having relatively fine particles entrained in a fluidizing gas, (B) transferring heat of combustion of the fuel to the fine, entrained bed particles in the combustor, (C) directing a selected first portion of the heated, fine entrained bed particles through and in contact with the steam generator such that heat is given up by the fine entrained bed particles to generate steam, (D) directing a selected second portion of the heated, fine entrained bed particles through and in contact with the superheater such that heat is given up by the fine entrained bed particles to superheat the steam, and (E) adjusting the amount of heat generated in the combustor and the relative amounts of first and second portions directed through the steam generator and superheater to obtain the desired temperature of the superheated steam.

2. The method according to claim 1 wherein the entrained bed combustor further comprises a stable, dense fluidized bed of relatively coarse particles through which at least some of the fine entrained bed particles pass.

3. The method for providing superheated steam as in claim 1 or 2 wherein the first and second portions of the fine entrained bed particles are recycled back to the combustor from the generator and superheater.

4. The method of claim 3 wherein the first and second portions comprise substantially the entire quantity of fine entrained bed particles.

5. The method of claim 3 wherein the first and second portions are mutually exclusive.

6. The method of claim 3 wherein a selected third portion of the fine entrained bed particles is directed through and in contact with a steam reheater and recycled back to the combustor.

7. The method of claim 3 wherein a selected fourth portion of the fine entrained bed particles bypasses the superheater and steam generator and is recycled directly back to the combustor.

8. The method of claim 3 wherein a fluidizing gas temporarily fluidizes the heated, fine entrained bed particles in the steam generator and steam superheater to increase their residence time therein.

9. A method of controlling the relative amount of heat provided to a steam generator, a steam superheater and a steam reheater for steam turbine operation comprising (A) generating heat from the combustion of fuel in an entrained bed combustor having a bed of relatively fine particles entrained in a fluidizing gas, (B) transferring the heat of combustion of the fuel to the fine entrained bed particles in the combustor, (C) providing independent flow paths for the heated, fine entrained bed particles through the steam generator, steam superheater and steam reheater such that they function in parallel, and (D) recycling preselected quantities of the fine entrained bed particles to the combustor through the independent flow paths of the steam generator, steam superheater and steam reheater such that heat is supplied thereto from the fine entrained particles in the desired relative amounts.

10. The method of claim 9 wherein the entrained bed combustor further comprises a stable, dense fluidized bed of relatively coarse particles through which at least some of the fine entrained bed particles are recycled.

11. The method of claim 10 wherein a preselected quantity of fine entrained particles bypasses the steam generator, steam superheater and steam reheater comprising providing an external flow path for the fine entrained bed particles directly from the upper portion of the combustor to the dense fluidized bed and recycling the preselected quantity of entrained bed particles therethrough.

12. Apparatus for generating and superheating steam to desired conditions independent of the steam flow rate comprising (A) a combustor for generating heat from the combustion of fuel, (B) separate steam generator and steam superheater external to the combustor, (C) a quantity of fine particles for withdrawing heat of combustion from the combustor and for transferring the heat to the steam generator or steam superheater, (D) means for entraining the fine particles in the combustor such that the fine particles are heated, (E) means for thereafter directing preselected quantities of heated fine particles independently through the steam generator or the steam superheater such that heat is supplied independently thereto from the heated, fine entrained bed particles, (F) means for recycling the fine particles from the steam generator and steam superheater back to the combustor, and (G) means for adjusting the amount of heat generated in the combustor and the relative quantities of heated fine particles recycled through the steam generator and steam superheater such that the desired conditions are obtained.

13. The apparatus of claim 12 wherein the combustor further comprises a stable, dense fluidized bed of relatively coarse particles.

14. The apparatus of claim 12 or 13 which further comprises (H) a separate reheater (I) means for directing a preselected quantity of heated fine particles independently through the reheater, (J) means for recycling the fine particles from the reheater back to the combustor, and (K) means for adjusting the quantity of heated fine particles recycled through the reheater relative to the quantities recycled through the steam generator and steam superheater.

15. The apparatus of claim 14 which further comprises (L) means for directly recycling heated fine particles from the combustor back to the combustor without passing through the steam generator, steam superheater or reheater.

* * * * *